United States Patent [19]

Angelini

[11] 4,217,861

[45] Aug. 19, 1980

[54] FLUE GAS REHEAT SYSTEM

[75] Inventor: Edward J. Angelini, Westfield, Mass.

[73] Assignee: Combustion Engineering, Inc., Windsor, Conn.

[21] Appl. No.: 960,408

[22] Filed: Nov. 13, 1978

[51] Int. Cl.[2] ..... F22B 33/18

[52] U.S. Cl. ..... 122/1 R; 122/32

[58] Field of Search ..... 122/1 R, 32, 33, 483; 110/203; 122/4 R

[56] References Cited

U.S. PATENT DOCUMENTS

| | | | |
|---|---|---|---|
| 2,681,047 | 6/1954 | Dalin et al. | 122/1 R |
| 3,148,665 | 9/1964 | Switzer | 122 1 R/ |
| 3,213,831 | 10/1965 | Hochmuth | 122/1 R |
| 3,221,710 | 12/1965 | Gallapoo | 122/1 R |
| 3,467,067 | 9/1969 | Clayton, Jr. | 122/33 |
| 4,121,541 | 10/1978 | Kneissl et al. | 122/1 R |

*Primary Examiner*—Edward G. Favors

*Attorney, Agent, or Firm*—Edward L. Kochey, Jr.

[57] ABSTRACT

An apparatus for reheating stack gases leaving a plurality of scrubbers which uses water within an associated steam generator as the heating source. A heat exchanger receives heat from the boiler water transferring it to a low pressure fluid which is circulated through heat exchange surfaces downstream of each of the scrubbers. The flow of the high pressure boiler water is controlled in response to a temperature of the low pressure fluid thereby providing a means for minimizing the flow and return temperature of the high pressure water. The high pressure water is taken from a circulating pump discharge and returned to the circulating pump suction.

4 Claims, 1 Drawing Figure

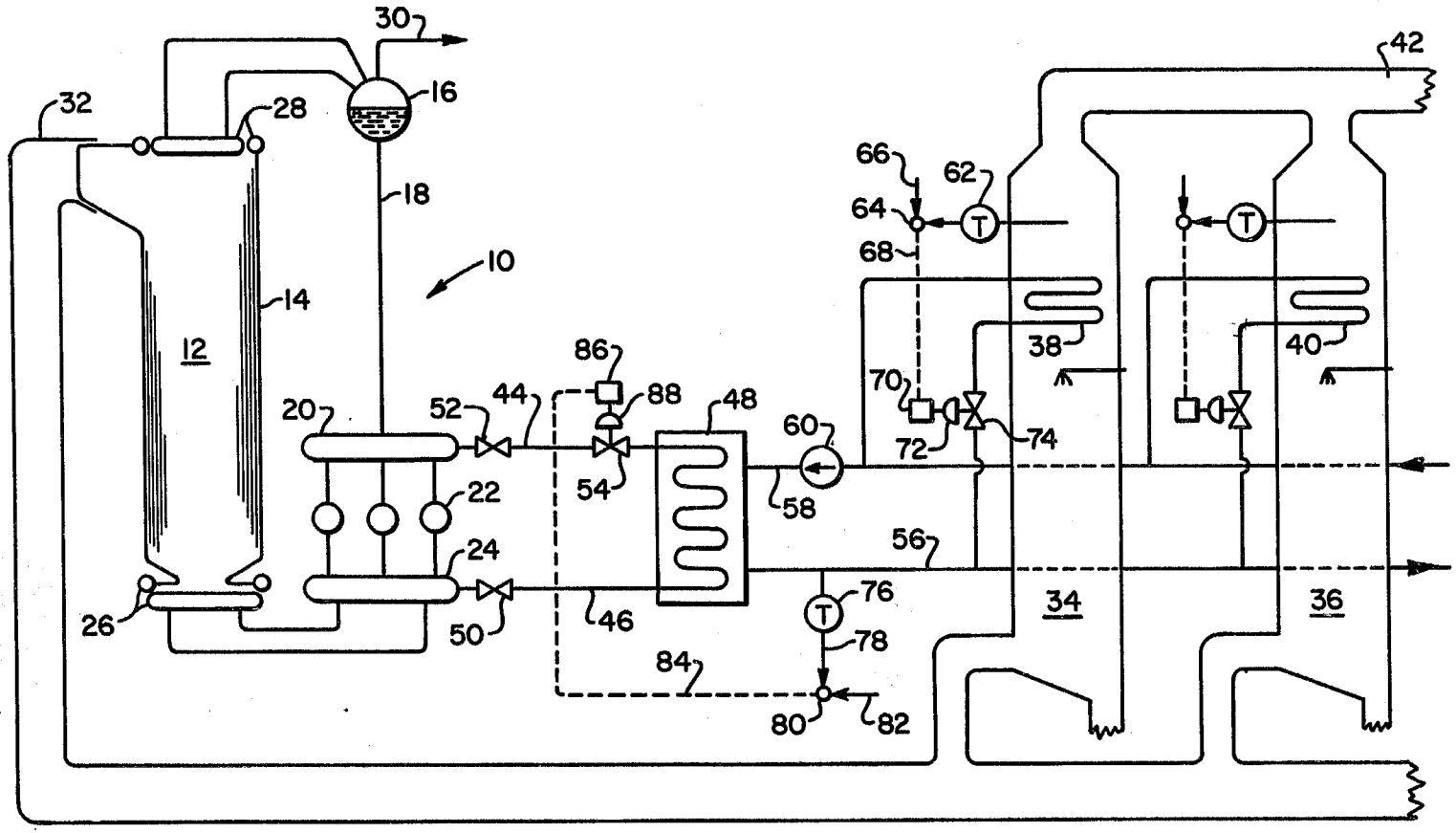
42
40
36
38
34
74
62
72
66
64
68
70
56
76
78
82
60
58
80
48
84
88
86
54
46
44
52
22
24
50
10
30
16
18
20
28
14
12
26
32

FLUE GAS REHEAT SYSTEM

BACKGROUND OF THE INVENTION

The invention relates to steam generators having wet scrubbers and in particular to the reheating of gases leaving the wet scrubbers.

The gases leaving wet scrubbers are saturated with water because of the scrubbing, and normally also include some entrained water carry over. This moisture leads to corrosion of downstream equipment and rainout in the immediate plant area. It also creates a visible and relatively dense plume in the gases leaving the stack. It is, therefore, customary to reheat these gases immediately after scrubbing for the purposes of avoiding such corrosion, rainout, and to increase the plume buoyancy.

The primary sources of heat for flue gas reheating have been extraction steam from the turbine, or hot water from the feedwater cycle. The use of extraction steam reduces the total kilowatt output of the station, and the use of water from the feedwater cycle requires that the feedwater cycle be oversized to supply this hot water. Since the feedwater is heated by extraction steam, this also reduces the kilowatt output of the station.

SUMMARY OF THE INVENTION

High pressure water is extracted from the lower drum of a steam generator and passed through the tube side of a heat exchanger. In this heat exchanger the heat is transferred to a low pressure fluid circulating on the shell side. The high pressure water leaves the heat exchanger and is returned to the steam generator at a location of the boiler circulating pump. A control valve is provided to regulate this flow of high pressure water. The flow may be regulated to minimize both its quantity and its return temperature.

The low pressure fluid is circulated through tubular reheating surface located downstream of each scrubber with the reheaters being arranged in parallel flow relationship with respect to the low pressure fluid. The flow through each reheater is regulated in accordance with the need of that particular scrubber.

The use of a reasonably low flow of the boiler water through the heat exchanger and the concomitant low temperature of return cooperates to decrease the loss of water through the furnace wall tubes, and in some cases to even increase it. Since the centrifugal boiler water circulating pump is essentially a constant volume device within the range being discussed here, the increased density of water caused by the low temperature return increases the weight flow of water pumped. In some high pressure situations this actually results in more of an increase of pumped water than is being passed through the heat exchanger.

BRIEF DESCRIPTION OF THE DRAWING

The FIGURE is a schematic illustration showing the steam generator, several scrubbers, and the heat exchange loops.

DESCRIPTION OF THE PREFERRED EMBODIMENT

Steam generator 10 has a furnace 12 lined with furnace wall tubes 14. Feedwater enters drum 16 where it is mixed with recirculated saturated boiler water passing through the downcomer 18 which includes a suction manifold 20, centrifugal circulating pumps 22 and a discharge manifold 24. The circulating pumps take their suction from manifold 20 and discharge to manifold 24.

The water is passed to lower furnace wall headers 26 from which it flows up through the furnace wall tubes 14 to the outlet headers 28 and thence to the steam drum 16. Steam passes out through line 30 to a superheater (not shown).

Fuel is burned within furnace 12 with the gases passing through outlet duct 32 and through a plurality of wet scrubbers 34, 36, and others not shown.

The gases are scrubbed in the lower portion of each scrubber and reheated by tubular reheating surfaces 38 and 40. The reheated gases pass out through duct 42 to a stack and thence to atmosphere.

The steam generator is operating at 2865 psig with a 688° F. saturation temperature. After mixing with feedwater in drum 16 the recirculated water passes at 684° F. through downcomer 18. In suction manifold 20 this flow is mixed with a flow of water through return line 44 which is described below. The mixed water at a temperature of 682° F. passes through circulating pumps 24 and is recirculated through steam generator furnace wall tubes 14.

A portion of the flow is taken from discharge manifold 24 through supply line 46 to a tube and shell heat exchanger 48. The high pressure water passes through the tube side of the heat exchanger and is returned through return line 44. Shutoff valves 50 and 52 provide for isolation of the circuit while control valve 54 provides a means for controlling the flow through the high pressure water loop.

A low pressure heat transfer loop is established through the shell side of heat exchanger 48. Supply line 56 conveys the low pressure fluid to a plurality of scrubber gas reheaters such as 38, 40, and others. The low pressure fluid is returned through return line 58 to the heat exchanger 48. Circulating pump 60 is operative to recirculate the fluid at a convenient rate.

With this arrangement that is transferred from the boiler water through the high pressure water circulating to the heat exchanger 48 to the low pressure fluid. It is then transferred in controlled amounts to each of the tubular gas reheaters in a controlled amount to reheat the gas to the desired level. The low pressure fluid should be maintained at the lowest level consistent with obtaining the degree of gas reheating desired. The circulation rate of the high pressure fluid is regulated to control the temperature of the low pressure fluid. Since the low pressure fluid is being maintained at a reasonably low temperature it follows that the amount of flow of high pressure water and the return temperature of the high pressure water are both minimized.

Temperature sensor 62 senses the temperature leaving scrubber 34 sending a control signal to summation point 64. The signal is compared with a set point temperature 66 which establishes a desired gas temperature of 150° to 200° F. An error signal passes through control lines 68 to controller 70 which in turn operates actuator 72 to modulate control valve 74. This controls the amount of low pressure fluid passing through the gas reheater 38 by varying the amount taken from supply line 56 and return to return line 58. Each of the scrubbers have similar control loops operating in parallel with the others.

The temperature required in the low pressure loop is a function of the amount of gas reheating surface, the required temperature of the reheated gases, and the quantity of gases. For the described installation the required temperature is 375° F. and accordingly the temperature sensor 76 emits a control signal through line 78 to summation point 80 where it is compared to a set point 82. Set point 82 is set for 375° F. An error signal passes through control line 84 to controller 86. This operates on actuator 88 to modulate control valve 54. Modulation of this valve varies the amount of high pressure water at 682° F. passing through the tube side of the heat exchanger 48 and thereby effects control of the temperature of the low pressure fluid. The high pressure water returning through line 44 is at a temperature of 480° F. This return high pressure water is preferably distributed throughout the length of the section manifold 20 to obtain a uniform mixing of this return water with the water passing through the upper portion of the downcomer 18.

Circulating pumps 22 are centrifugal pumps, with their primary purpose being to circulate boiler water through furnace wall tubes 14. Within the range under discussion these pumps are essentially constant volume pumps. The total pump capacity is 18,400 gpm. If no heat were to be extracted for the gas reheating, they would be pumping water at 684° F. having a specific volume of 0.0306 pounds per cubic foot. This would result in the pumping of 19,340,000 pounds per hour. The return of 370,000 pounds per hour of high pressure water which is required for the heat exchanger at a return temperature of 480° F. reduces the temperature of the water being pumped to 682° F. This reduces the specific volume to 0.0299 cubic feet per pound. The flow of 18,400 gpm now represents a flow of 19,800,000 pounds per hour. It can be seen that even with the subtraction of the 370,000 pounds per hour passing to the heat exchanger the remainder of 19,430,000 represents an actual increase over the amount pumped in the absence of the heat exchanger. Therefore, for the particular temperature pressure conditions existing there not only is no detrimental effect to the waterwall but an actual benefit in the circulation through the waterwall for the same pump.

It would appear that this phenomenon of an actual increase in furnace wall circulation with the use of the heat exchanger is most likely to occur at high temperature and high pressure where the specific volume of the water changes more rapidly with a change in enthalpy than does the temperature. However, even in situations where the furnace wall flow does not increase, the decrease is minimized by using a reasonably minimum temperature in the low pressure loop and a concomitant minimum flow and minimum return temperature in the high pressure water loop. Where a circulating pump is not used, a similar result will be obtained if the return water is returned at a high elevation since it increases the density of the water in the downcomer and accordingly increases boiler water circulation. In such a situation, however, where a circulating pump is not used in the steam generator a separate pump would be required for the high pressure recirculating loop.

What is claimed is:

1. In a gas reheating system for a steam generator and a plurality of wet scrubbers, said steam generator having tubes lining a furnace wall and water flowing therethrough, downcomer means arranged to recirculate water from a location downstream of said tubes to a location upstream of said tubes, said wet scrubbers receiving flue gases from said steam generator and discharging the gases to atmosphere, and tubular gas reheating surface located in the stream of discharging gas from each wet scrubber, the improvement comprising: a heat exchanger; means for conveying a low pressure fluid from said heat exchanger to and from each of said gas reheating surfaces; means for circulating the low pressure fluid through said heat exchanger and each of said gas reheating surfaces; and means for circulating high pressure water from said downcomer means through said heat exchanger in heat exchange relationship with the low pressure fluid and for returning the high pressure water to said downcomer means.

2. An apparatus as in claim 1: wherein said downcomer means includes a pump having suction and discharge sides; said means for circulating high pressure water connected to receive water from the pump discharge side and to return water to the pump suction side.

3. An apparatus as in claim 1 or 2: having also means for measuring a temperature of the low pressure fluid; and means for regulating the flow of high pressure water in response to said means for measuring temperature of low pressure fluid.

4. An apparatus as in claim 3: wherein said means for measuring temperature of low pressure fluid comprises means for measuring the temperature of the low pressure fluid leaving said heat exchanger.

* * * * *